US006203285B1

(12) United States Patent
Wagner et al.

(10) Patent No.: US 6,203,285 B1
(45) **Date of Patent: *Mar. 20, 2001**

(54) COMPRESSOR INTERCOOLER UNLOADER ARRANGEMENT

(75) Inventors: Daniel G. Wagner, Pittsburgh; Brian L. Cunkelman, Blairsville; Walter E. Goettel, Monogahela, all of PA (US)

(73) Assignee: Westinghouse Air Brake Company, Wilmerding, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/080,858

(22) Filed: May 18, 1998

(51) Int. Cl.[7] ..... F04B 23/00
(52) U.S. Cl. ..... 417/243; 417/53
(58) Field of Search ..... 417/53, 243

(56) References Cited

U.S. PATENT DOCUMENTS 3,096,927 * 7/1963 Wahl ..... 230/26
4,525,661 * 6/1985 Mucsy et al. ..... 322/4
4,756,669 * 7/1988 Hata ..... 417/12
4,831,313 * 5/1989 Beilfuss ..... 388/822
5,195,874 * 3/1993 Odagiri ..... 417/27

* cited by examiner

*Primary Examiner*—Charles G. Freay
*Assistant Examiner*—Timothy P. Solak
(74) *Attorney, Agent, or Firm*—James Ray & Associates

(57) ABSTRACT

Apparatus for rapidly unloading air pressure in an intercooler to atmosphere when a compressor pneumatically connected to the intercooler is unloaded. The apparatus includes a governor pneumatically connected to a reservoir, that, in turn, is connected to receive pressurized air from the air compressor. The governor has a pressure sensing device operable to order unloading of the compressor when air pressure level in the reservoir tank reaches a preset level. An electrically operated valve is pneumatically connected to the intercooler and connected electrically to the pressure sensing device of the governor, with the electrically operated valve being effective to exhaust air pressure in the intercooler when the valve receives an unload signal from the pressure sensing device. The compressor is driven, by an electrical motor having one or more speed configurations, with transition occurring between one configuration and another when the compressor is unloaded. The electrically operated valve is effective to unload the intercooler at the time of speed configuration transition to reduce undue motor and electrical contactor heat and thus increase life expectancy of the motor and contactors.

9 Claims, 1 Drawing Sheet

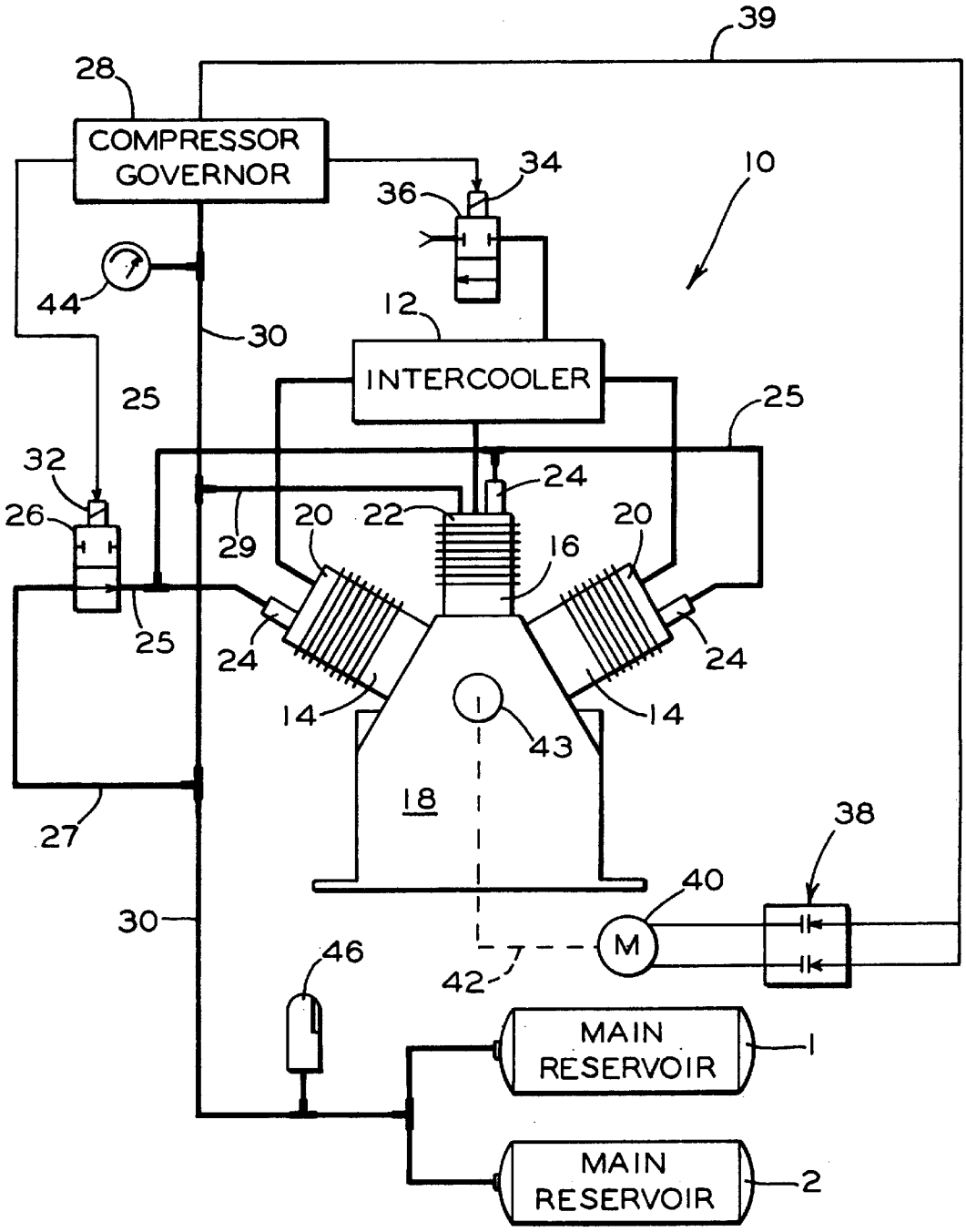
39
28
COMPRESSOR GOVERNOR
34
36
10
44
12
30
INTERCOOLER
25
25
32
24
26
20
22
20
29
16
25
24
24
14
14
43
18
27
38
40
30
M
46
42
MAIN RESERVOIR
1
MAIN RESERVOIR
2

COMPRESSOR INTERCOOLER UNLOADER ARRANGEMENT

FIELD OF THE INVENTION

The present invention relates generally to air compressors used on locomotives, and particularly to a pneumatic and electrical circuit arrangement that permits rapid unloading of an intercooler unit pneumatically connected between low pressure heads and a high pressure head of a compressor.

BACKGROUND OF THE INVENTION

U.S. Pat. No. 5,106,270 to Goettel et al discloses a two stage compressor and intercooler/aftercooler arrangement for providing pressurized air for the operation of brakes and other devices on locomotives and trains of railway cars connected to such locomotives. As disclosed in the patent, the compressor has two low pressure cylinders and a high pressure cylinder that develop air pressure. Between the high pressure cylinder and cylinder head and the low pressure cylinders and their heads are located intercoolers that cool the pressurized air generated in the low pressure cylinders before such air is sent on to the high pressure cylinder for high pressure air development. A single intercooler core design is also available that collectively receives the air discharged from the low pressure cylinder heads and cools the air before entering high pressure head's inlet flange for the second stage of compression. Air, of course, increases in temperature as it is pressurized. Thus, the need for intercoolers and an aftercooler in the Goettel et al disclosure.

Air produced by the two stage air compressor is usually stored in two main reservoirs located on the locomotive. Maximum pressure provided by the compressor is controlled by a pressure sensitive switch of a governor that is pre-set to regulate the operation of the compressor for loaded and unloaded conditions of the compressor. The compressor normally unloads whenever the main reservoir pressure increases to a "cut-out" pressure setting of the governor pressure sensitive switch. A reduction in main reservoir pressure caused by air use or air leakage, as sensed by a "cut-in" pressure switch setting of the governor, exhausts compressor unloader lines to allow the compressor to again compress air and assume a loaded condition. The governor's pressure sensing switch energizes a magnet valve whenever main reservoir pressure reaches the governor's cut-out pressure switch setting. The magnet valve has an electromagnetic coil that operates the valve. Main reservoir pressure enters the unloader lines of the compressor to unload the compressor and associated intercoolers.

The compressor governor switch is normally located between the number 1 and number 2 main reservoirs in a locomotive.

Each of the cylinders of the compressor in the above U.S. Goettel et al patent is provided with two unloader valves, one for each of two inlet valves of each cylinder, for unloading pressure from cylinder heads when main reservoir pressure increases to the "cut-out" pressure setting of the governor. Main reservoir air is directed to the unloader valves by the magnet valve when its coil receives a voltage signal from the governor's pressure switch. This occurs when electrical contacts of the switch close to energize the compressor magnet valve. Main reservoir pressure, operating through and supplied by the energized magnet valve, moves the unloader valves to unseat an intercooler pressure seal valve (located within unloader valve bodies) and compressor suction valves that are pneumatically connected to the intercoolers. The unseated unloader suction valves prevent the compressor from building air pressure from the ambient outside air taken in by the compressor.

Air is slowly exhausted from the intercoolers whenever the compressor is unloaded by connections between the intercoolers and the high pressure cylinder, i.e., air passes through the unloader valves, past the open intercooler pressure seal valve and through an exhaust port of the unloader valves to atmosphere. Such an exhaust path and procedure requires about twenty-five seconds for the intercoolers to unload their air pressure through the high compression cylinder of the compressor and its unloader valve.

Locomotive compressors are usually driven by an electrical motor having a rotor mechanically connected to the crankshaft of the compressor, though a compressor can be driven directly by the diesel powered engine of the locomotive. When driven by an electrical motor, electrical contactors supply power to the motor whenever compressed air is needed, as ordered by the compressor governor switch. Presently used compressor drive motors are usually a dual speed type. The speed of such motors operate in a predetermined relationship to the speed of the diesel engine of the locomotive, i.e., when the diesel engine speed is between a low idle and some intermediate throttle speed, the compressor motor operates at a high speed configuration, which provides a motor rpm generally twice that of diesel engine speed. When diesel engine speed is between the intermediate speed and a top speed, electrical power is supplied to a low speed configuration of the motor, and the compressor runs at substantially the speed (rpm) of the diesel engine.

The transition time from one configuration of a motor to the other configuration is quite short, on the order of two seconds, such that intercooler pressure may be at its maximum when the transition occurs even though the compressor itself at this time is unloaded. If the intercooler is not unloaded, its pressure is supplied to the high pressure cylinder of the compressor. When a motor transition occurs, the motor starts at the new configuration against any residual pressure in the compressor, such that the motor can be unduly loaded. The motor, in turn, requires an increase in current flow which overheats the motor and shortens its life. The increase in current flow also burns the electrical contactors supplying power to the motor.

OBJECTIVES OF THE INVENTION

It is therefore an objective of the invention to unload intercooler pressure at the unloading of a compressor connected to the intercooler within the time it takes to transition from one speed configuration of a motor driving the compressor to another speed configuration.

Another objective of the invention is to eliminate compressor motor heat buildup by eliminating the possibility of the motor starting against an air load retained in the intercooler.

A further objective of the invention is to extend the life of a compressor drive motor and electrical supply contactors by eliminating the possibility of the motor starting against intercooler pressure.

SUMMARY OF THE INVENTION

In the present invention, intercooler pressure is quickly exhausted to atmosphere by use of a magnet or solenoid operated valve located on an intercooler, the valve being effective to exhaust intercooler pressure within about two seconds. The intercooler solenoid valve is energized with the energization of a compressor magnet valve during speed transition of a motor driving the compressor upon the magnet valve receiving a signal voltage from a pressure sensing governor that controls operation of the compressor.

THE DRAWING

The invention, along with its objectives and advantages, will be better understood from consideration of the following detailed description and the accompanying drawing, the sole FIGURE of which is an electrical and pneumatic circuit diagram of the invention wherein a schematic intercooler is exhausted by a valve electrically operated when a magnet valve orders the exhaust of the cylinders of a compressor connected to the intercooler.

PREFERRED EMBODIMENT OF THE INVENTION

Referring now to the drawing FIGURE, a pneumatic and electrical system 10 is shown for rapidly exhausting an intercooler (IC) 12 connected in fluid.communication between a high pressure cylinder 16 and two low pressure cylinders 14 of an air compressor 18. As explained earlier, the intercooler cools low pressure air issuing from low pressure heads 20 of cylinders 14 before such air reaches high pressure head 22 of cylinder 16. The cooling action is performed by heat exchange tubes (not shown) of the intercooler receiving pressurized air from cylinders 14.

In the FIGURE, each cylinder head (20 and 22) of compressor 18 is shown provided with an unloader valve 24 for unloading (exhausting) air from the cylinders of the compressor. These valves are shown commonly and pneumatically connected via unloader lines 25 to a magnet valve 26 pneumatically connected, in turn, by a pipe 27 to main reservoirs 1 and 2 of a locomotive.

The high pressure cylinder 16 and head 22 supply compressed air to the main reservoirs 1 and 2 via a pipe 29.

Pressure between reservoirs 1 and 2 is sensed by a compressor governor (CG) 28 shown connected, in the FIGURE, to the reservoirs by a pneumatic conduit 30. Governor 28 includes a pressure sensing means (not shown) connected to a magnet coil 32 of magnet valve 26, as well as to a magnet or solenoid 34 of an exhaust valve 36 connected pneumatically to intercooler 12. The pressure sensing means of governor 28 can be a pressure sensing transducer and microprocessor or it can be the more typical electrical switch operated by changes in air pressure reaching the governor via conduit 30.

Valve 36 can be connected to the intercooler at any location that permits immediate exhausting of pressurized air contained in cooling, heat exchange tubes and headers (not shown) of the intercooler.

The transducer or switch of governor 28 is also connected to an electrical system for controlling motor 40, as represented in the drawing by two solenoid operated electrical/mechanical contactors 38 and an electrical line 39. Contactors 38 supply and interrupt electrical current to a motor 40 under control of the governor. The motor 40 drives the compressor's crankshaft via a tapered interference fit between a tapered crankshaft of the compressor and a tapered bore of the rotor of motor 40, i.e., the compressor and the motor share a common shaft 42/43.

Motor 40 is of the type having at least two operable pole configurations, with one of the electromechanical contactors 38 supplying electrical current to the poles of one configuration, when closed, and the other contractor open. When the open and closed contactors are reversed, the other pole configuration is energized.

The pressure in reservoirs 1 and 2 can be indicated by and read from a pressure sensing meter 44 connected to conduit 30, and excessive pressure in the reservoirs can be relieved by a safety valve 46 pneumatically connected to the reservors.

Heretofore, pressure in the cylinders 14 and 16 of a compressor 18 was unloaded via unloader valve 24 when governor 28 sensed a preset pressure value in reservoirs 1 and 2, the governor switch or transducer being preset to a "cut-out" pressure value. The compressor remained unloaded until the governor sensed a "cut-in" (low) pressure level in the reservoirs, at which time air was exhausted from the unloader valves and the compressor allowed to begin compressing the air it receives from the ambient outside of the compressor.

As explained above, one or more intercoolers exhaust air through the unloader valve of high pressure cylinder 16, the time required for intercooler exhaustion being on the order of twenty-five seconds. The time required for a motor having two different speed configurations to change from operating at one configuration to operating at the other configuration can be as short as two seconds. Hence, when the magnet 32 of magnet valve 26 was ordered to supply reservoir air to unloader valves 24 via unloader lines 25 for unloading the compressor cylinders, motor 40 was ordered to change speed configuration, all under the control of governor 28. Unexhausted air pressure residing in the intercooler(s) 12 was supplied to high pressure cylinder 16 of the compressor such that the new speed configuration of motor 40, as ordered by the governor, had to start against a compressor (18) containing pressurized air. This overloaded compressor drive motors (40) and their current supplying contactors (38) which greatly shortened the life of such motors and contactors.

The resent invention solves this problem by exhausting intercooler air directly to atmosphere from valve 36 connected directly to the intercooler. When governor 28 senses a preset pressure level in reservoirs 1 and 2, it signals the solenoid or magnet 34 of valve 36 to immediately exhaust pressurized air from the heat-exchange tubes of the intercooler. This occurs at the time of speed configuration transition of motor 40 and the operation of unloader valves 24 that unload compressor 18. The exhausting or unloading of the intercooler is rapid, on the order of two seconds or less, such that with a two second change-over of motor 40, the motor starts against an unloaded compressor.

While the presently preferred embodiment for carrying out the instant invention has been set forth in detail, those persons skilled in the locomotive compressor art to which this invention pertains will recognize various alternative ways of practicing the invention without departing from the spirit and scope of the claims appended hereto.

What is claimed is:

1. An improved intercooler unloading apparatus for communicating any excess air pressure to atmosphere from an intercooler when an air compressor powered by an electrical motor having a different number of magnetic poles that provide different motor speeds when one set of magnetic poles is activated and another set is deactivated and pneumatically connected to said intercooler is unloaded, said motor being capable of changing speeds in a substantially short period of time, said improved intercooler unloading apparatus comprising:

(a) a governor pneumatically connected to at least one reservoir tank that is connected to receive pressurized air communicated thereto from said air compressor, said governor including a pressure sensing means for determining an air pressure in said at least one reservoir tank and for generating and communicating an electrical unloading signal to initiate unloading of said air compressor when a level of said air pressure present in said at least one reservoir tank reaches a preset value; and (b) an electrically operated valve, said electrically operated valve being pneumatically connected to said intercooler and electrically connected to said pressure sensing means of said governor, said electrically operated valve being effective to exhaust air pressure present in said intercooler to atmosphere within the short time period required for the motor to change speeds when said electrically operated valve receives said electrical unloading signal from said pressure sensing means of said governor such that the electrical motor can change speeds against an unloaded compressor and intercooler.

2. An air compressor arrangement, according to claim 1, wherein said electrical motor includes a control system for at least providing said electrical motor with electrical current.

3. An air compressor arrangement, according to claim 2, wherein said control system further provides control of at least one speed configuration of said electrical motor.

4. An air compressor arrangement, according to claim 3, wherein said control system provides control of a predetermined plurality of speed configurations of said electrical motor.

5. An air compressor arrangement, according to claim 4, wherein said pressure sensing means of said governor is electrically connected to said control system for ordering said air compressing means to unload when transition of said electrical motor from operating at a first speed configuration to a second speed configuration occurs with said transition occurring in a relatively short period of time.

6. An air compressor arrangement, according to claim 5, wherein said electrically operated valve is effective in unloading said air pressure present in said intercooler to atmosphere during said relatively short period of time of said transition of said electrical motor from operating at said first speed configuration to said second speed configuration.

7. A method of rapidly exhausting air pressure from an intercooler when an air compressor driven by a multi-speed power means and having a different number of magnetic poles pneumatically connected to said intercooler is unloaded, said multi-speed power means being capable of changing speeds within a substantially short period of time when one set of magnetic poles is activated and another set is deactivated, the method comprising the steps of:

(a) sensing an air pressure in an at least one reservoir supplied by said air compressor;

(b) initiating unloading of said air compressor when said air pressure present in said at least one reservoir reaches a preset level; and (c) operating an electrically operated valve pneumatically connected to said intercooler and electrically connected to a means for sensing said air pressure in said at least one reservoir to initiate unloading of air pressure from said intercooler when within the short period of time for changing the speed of said power means said electrically operated valve receives an unload signal from said pressure sensing means.

8. Apparatus for rapidly unloading air pressure in an intercooler when a compressor pneumatically connected to said intercooler is unloaded, comprising:

a governor pneumatically connected to at least one reservoir tank connected to receive pressurized air from the compressor, said governor having pressure sensing means operable to order unloading of the air compressor when air pressure level in said tank reaches a preset value, an electrically operated valve connected pneumatically to the intercooler and connected electrically to the pressure sensing means of said governor, said electrically operated valve being effective to exhaust the air pressure in said intercooler to atmosphere when said valve receives an unload signal from the pressure sensing means, and an electrical motor having a different number of magnetic poles that provide different motor speeds when one set of magnetic poles is activated and another is deactivated under control of a system for providing the motor with electrical current, with the sensing means of said governor electrically connected to the control system of said motor for ordering the compressor to unload when transition of the motor from operating at one speed configuration to operating at another speed configuration occurs, said transition occurring in a substantially short time period, with the valve being effective to unload intercooler air pressure during the short time period of said motor transition.

9. An intercooler/compressor arrangement wherein the intercooler of the arrangement supplies low pressure air to a high pressure cylinder of the compressor and wherein the compressor is driven by an electrical motor having at least two different speed configurations and a control system for respective energization of the two speed configurations, the arrangement comprising:

a governor pneumatically connected to at least one reservoir tank connected to receive pressurized air from the compressor, said governor having pressure sensing means operable to order unloading of the air compressor when air pressure level in said reservoir tank increases to a preset value, and an electrically operated valve connected pneumatically to the intercooler and connected electrically to the sensing means of said governor, said sensing means, in addition, being connected to the control system of the electrical motor for ordering transition of the motor from operating at one speed configuration to operating at the other speed configuration, said transition occurring in a relatively short period of time, and said electrically operated valve being effective to exhaust air pressure in the intercooler to atmosphere during the time period of motor speed transition when the electrically operated valve receives an unload signal from said sensing means.

* * * * *